United States Patent [19]

Heuvelman

[11] Patent Number: 4,624,066

[45] Date of Patent: Nov. 25, 1986

[54] DREDGE WITH TWIN CUTTER HEAD AND SUSPENSION THEREFOR

[75] Inventor: Cornelis Heuvelman, Den Haag, Netherlands

[73] Assignee: Zanen Verstoep N.V., Leidschendam, Netherlands

[21] Appl. No.: 730,895

[22] Filed: May 6, 1985

[30] Foreign Application Priority Data

Dec. 14, 1984 [NL] Netherlands ..... 8403797

[51] Int. Cl.[4] ..... E02F 3/92

[52] U.S. Cl. ..... 37/65; 37/72

[58] Field of Search ..... 37/64–67, 37/61–63, 58, 59, 72

[56] References Cited

U.S. PATENT DOCUMENTS

| | | | |
|---|---|---|---|
| 939,227 | 11/1909 | Diehl | 37/64 |
| 2,762,136 | 9/1956 | Bell | 37/67 |
| 2,933,837 | 4/1960 | Nelson | 37/65 |
| 3,624,933 | 12/1971 | Faldi | 37/72 X |
| 3,876,258 | 4/1975 | Abderhalden | 37/65 X |
| 4,400,895 | 8/1983 | Verboom | 37/58 |

FOREIGN PATENT DOCUMENTS

| | | | |
|---|---|---|---|
| 1816221 | 7/1970 | Fed. Rep. of Germany | 37/64 |
| 2923518 | 12/1980 | Fed. Rep. of Germany | 37/64 |
| 2129 | 1/1980 | Japan | 37/64 |
| 168731 | 10/1983 | Japan | 37/58 |
| 92978 | 12/1959 | Netherlands | 37/67 |
| 7901450 | 8/1980 | Netherlands | 37/58 |
| 383799 | 9/1973 | U.S.S.R. | 37/65 |
| 779517 | 11/1980 | U.S.S.R. | 37/64 |

*Primary Examiner*—Clifford D. Crowder

*Attorney, Agent, or Firm*—Blum Kaplan Friedman Silberman & Beran

[57] ABSTRACT

A dredge provided with a twin cutter in a container unit which is suspended from the ladder yoke in a hanger and tip tackle. Stay tackle structure is provided extending between port and starboard of the dredge vessel in a cross-wise manner to the opposite lateral sides of the support frame for maintaining the position of the cutter as it is moved through the soil. Each cutter with its motor drive is mounted in a casing in the form of a standard cargo container.

10 Claims, 4 Drawing Figures

DREDGE WITH TWIN CUTTER HEAD AND SUSPENSION THEREFOR

This invention relates to a dredge, comprising a cutter which, when dredging at normal working depths of no more than approximately 30 meters, is to be extended above the track to be dredged by a ladder on a ladder hoisting stand.

For dredging at greater depths the use of a ladder is not feasible, however. The aim is thus directed on making a provision that can replace the ladder when working at depths of more than 30 meters.

For that purpose the present invention comprises a new provision which is characterized in that for the work at greater depth the cutter is mounted on a support frame which is connected to the ladder hoisting stand by a hanger tackle and a tip tackle. Due to this the cutter can be lowered to great working depths, and the position of the support frame and the cutter fore and aft and athwartships is maintained by combined longitudinal and transverse tackles. An important aspect in this respect is that all of said tackles are each connected in opposite points on the periphery of the support frame. With respect to a central suspension, such a well-spread suspension tackle has the advantage that a good stabilization of the dredge in operation is provided.

However, due to the lack of the fixed support as offered by a ladder to a cutter carried thereby, the withdrawal from the load by the cutter, in reaction to the couple to be exerted in operation, should be obviated in the above-described so-called bridle tackle which is provided by the present invention, since otherwise obviously no proper cutting action can be performed, and for that purpose, in the here presented device, the further measure is provided that the cutter for a reaction-free action consists of a twin cutter, with its cutters to be rotated in opposite directions, a rational construction of which is constructed so that each cutter with the pertaining motor drive is mounted in a casing in the form of a standard cargo container with a length of e.g. 6 m and with a width and height of 2.4 m, which does not only facilitate the chucking of the twin cutter in the support frame, but which also makes this dredge well-transportable.

It is furthermore remarked with respect to the bridle tackle that the tendency towards rotation of the support assembly which is suspended from the ladder hoising stand with its hanger and tip tackle, and with the cutter mounted thereon, is obviated by combined longitudinal and transverse tackles passed between port and starboard, with crosswise-passed tackle ropes extending obliquely upwards to pulleys arranged more forwardly at the boards of the vessel, and from there to the winch on board, to thus ensure a well-stabilized position of the dredging implement in its operation under the heavy own weight of this implement which can amount to 150 tons, and that also the accurate depth position and cutting depth of the dredging implement are ensured by means of constant tension winches and heave compensators so that the operation can also proceed on a less cleared uneven track, and in case of some swell.

The novel cutter is further characterized in that it has the configuration of a cylindrical crown formed by a ring of knives, with open passages therebetween, said knives being connected by a shroud to which an internal gear ring is connected, which is adapted to be driven for rotation of the cutter which is journaled on one or more roller rings, by drive pinions on the motor shaft, and the motor, or preferably two opposite motors, is, or are, laterally arranged to keep the central passage free for the suction tube which extends into the knive crown, and in a preferred embodiment said knive crown being formed so that the ring of knives is connected by a second shroud which is situated away from said first shroud towards the cutter end, whereby the knive ends which terminate in an inwardly curved configuration, can then remain unsupported.

The discharge of the dredged soil takes place so that the suction tube is connected via the dredge pump which is also mounted in the container casing of the dredging implement, and via a bend with a swivel and a further pivot connection, to a buoyant pressure line through which the slurry is transported to its destination.

A further aspect is that the support frame is constructed in the form of a support cage, composed of rods, in which the twin cutter is to be mounted, said support cage being adapted to be hoisted and tipped, or as an alternative, the support cage is adapted to be hoisted while the cutter is journaled therein to be tipped, and with the tip tackle then being directly connected to the cutter, and furthermore the aim can also be that the support frame or the cutter is provided with a ground guide determining the cut depth.

Still further features and aspects of the cutter and the way of mounting it, according to the invention, will appear in more detail from the following description in view of illustrative embodiments thereof, as represented in the drawings, which are, however, not to be interpreted in a restrictive sense as, of course, other embodiments are possible within the scope of the invention.

Figure 1:
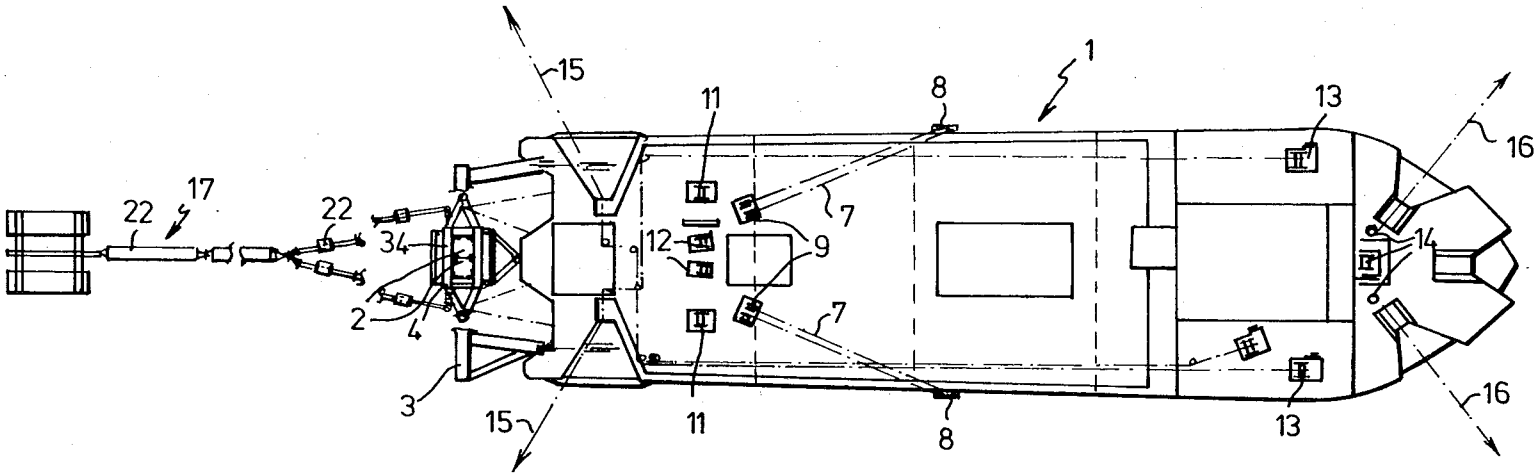
FIG. 1 is a plan view of a dredge with a twin cutter according to the present invention.
Figure 2:
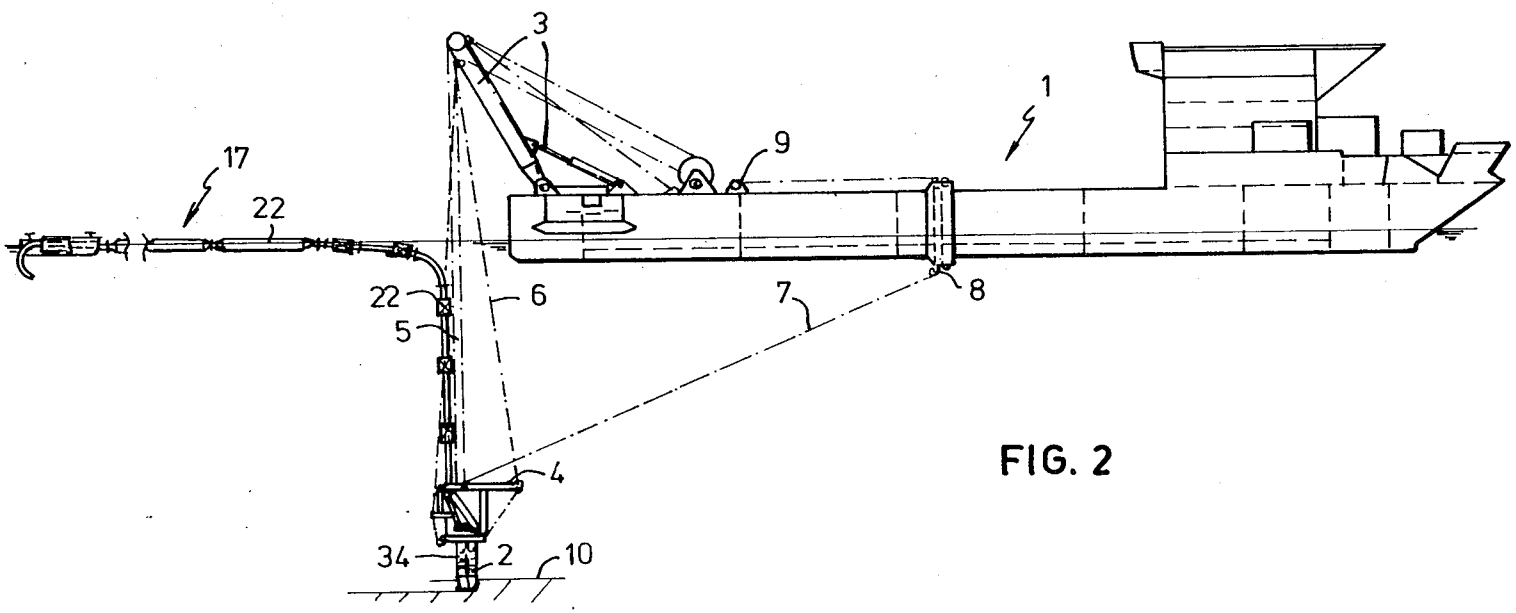
FIG. 2 is a longitudinal view of the dredging installation as represented in FIG. 1.
Figure 3:
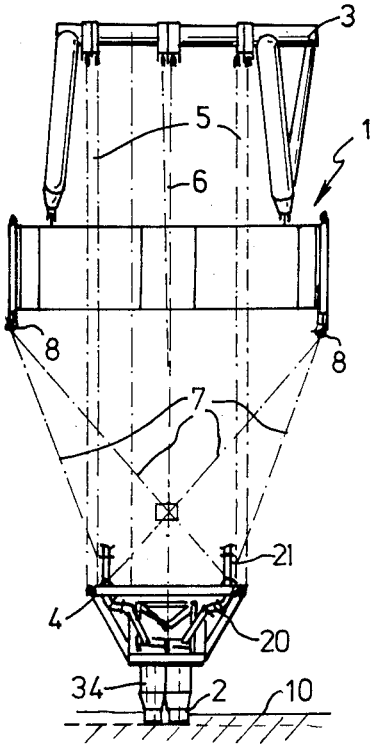
FIG. 3 is a rear end view thereof.

In FIG. 1 through 3 a dredge is represented, which when dredging up to a working depth of no more than approximately 30 meters, extends the cutter 2 on a normal ladder (not represented here) which is suspended from a ladder hoisting stand 3.

For dredging in deep waters a novel provision replaces the ladder, said provision comprising a support frame 4 in which a twin cutter 2 is to be chucked, and which is connected to the ladder hoisting stand 3 by a hanger tackle 5 and a tip tackle 6.

Furthermore a combined fore and aft and athwartships stay tackle 7 is arranged between the support frame 4 and the vessel 1, extending from the support frame 4 obliquely upwards and forwardly to pulleys 8 at the boards of the vessel 1 and from there to one or more winches 9 which are arranged on board, and of which tackle 7 the tackle ropes, as can be seen in FIG. 3, are passed crosswise so as to well stay the dredging implement 2 when it is moved through the soil 10.

Furthermore in FIGS. 1 and 2 winches 11 and 12 are shown, controlling the hanger tackle 5 and the tip tackle 6, respectively, and consisting of constant tension winches so as to tension the tackle ropes to the right extent when following the motion of the dredging implement 2, also on an uneven track.

The winches 13 and 14 control the guy lines 15 and anchor lines 16 whcih are indicated with dot-dash lines in FIG. 1.

As can be seen in FIG. 3, the support frame 4 is constructed in the form of a support cage, composed of rods, and with the twin cutter 2 being chucked therein.

The tackles 5, 6 and 7 are each connected in opposite points on the periphery of the support frame 4, due to which well spread suspension tackle a good stabilization of the cutter 2 in its operation is obtained.

The pressure line 17 which is connected to the suction tube 18 in the cutters 2 via a dredge pump 19 and via a swivel 20 and a further pivot connection 21, is floated by buoyant line members 22.

Figure 4:
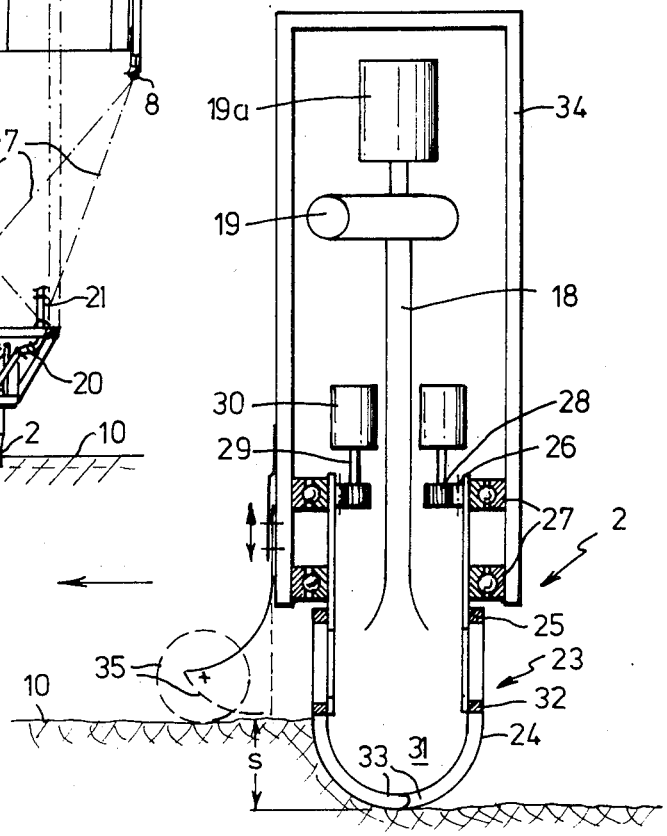
FIG. 4 is a longitudinal cross-section through the novel cutter.

The construction of the twin cutter 2 will be further described in view of FIG. 4.

The cutter 2 consists of an open cylindrical crown 23 formed by a ring of knives 24 which are interconnected by an annular shroud 25 to which an internal gear ring 26 is connected, which is adapted to be driven for rotation of the cutter 2 which is journaled on one or more roller rings 27, by drive pinions 28 on the shafts 29 of the two motors 30. A central passage is left between the motors 30 and their drive shafts 29 and pinions 28, through which passage the suction tube 18 extends into the crown or ring 23 of knives, as is seen in FIG. 4.

Toward the crown 23 the cutter end 31 is provided with a second shroud 32 for girding the knives 24, through which good support of the knives 24 which extend along helical lines, the knive ends 33 which terminate in an inwardly curved configuration at the cutter end 31, can then remain unsupported.

The entire assembly consisting of the suction tube 18, dredge pump 19, cutter motors 30 and drive means 28, 29 connected thereto, pump motor 19*a* and roller rings 27, is accommodated in a casing 34 in the form of a standard cargo container of from 20 to 40 feet at a height and width of 8 feet, which is well adapted for chucking the support frame 4 therein and due to which such a dredging implement is also well-transportable.

It is remarked that the cutters 2 can also be journaled to be tipped in the support frame 4. The tip tackle 6 is not connected to the support assembly 4 then, but directly to the cutter casings 34.

The structure can furthermore be equipped with ground guides 35 which determine the cutting depth s, in the form of a wheel or slide, as schematically indicated in FIG. 4, which guides 35 are to be adjustably mounted on the cutter casing 34.

I claim:

1. A dredge for deep water operation from a vessel, comprising:

a hoisting stand mounted on the vessel;

a support frame formed as an open work cradle, depending from the hoisting stand;

a cutter mounted in the support frame;

hanger tackle means coupled between opposite lateral sides of the cradle and the hoisting stand for controlling the cradle in the vertical direction;

tip tackle means coupled between fore and aft sides of the cradle and the hoisting stand for controlling the fore and aft tipping movement of the cradle; and stay tackle means for coupling the support frame and the vessel;

said stay tackle means extending between port and starboard of the vessel in a cross-wise manner to the opposite lateral sides of the support frame for maintaining the position of the cutter as it is moved through the soil;

said cutter being a twin cutter in parallel spaced relationship to each other for simultaneous attack on the ground, rotatable in opposite directions for providing a reaction free action.

2. The dredge of claim 1, further including a casing shaped as a standard cargo container, and motor means mounted in the casing for driving each cutter of the twin cutter.

3. The dredge of claim 2, wherein the cutter further comprises at least one roller ring mounted in the casing, the cutter being journaled on the at least one roller ring, an internal gear ring mounted in the casing for rotationally driving the cutter, a shroud mounted in the casing and being connected to the gear ring, a plurality of semi-annular knives attached to the shroud forming a cylindrical crown with open passages between each knife and a drive pinion mounted on the motor means for rotating the cutter.

4. The cutter of claim 3, further comprising a suction tube extending into the crown of semi-annular knives, a second shroud being mounted in the casing away from said first shroud, and wherein at least one motor means is laterally arranged to keep the central passage free for the suction tube said knives connected by the second shroud, and wherein said semi-annular knife ends terminate in an inwardly curved configuration and are unsupported.

5. The dredge of claim 4, further including a dredge pump mounted on the suction tube, both being mounted in the container casing, a bouyant pressure line outside of said container casing and connected to the dredge pump.

6. The cutter of claim 3, further comprising a suction tube extending into the crown of semi-annular knives, a second shroud being mounted in the casing away from said first shroud, said two motor means are laterally arranged to keep the central passage free for the suction tubes, and said knives connected by the second shroud, and wherein said semi-annular knives ends terminate in an inwardly curved configuration and are unsupported.

7. The dredge of claim 2, wherein the support frame is constructed in the form of a support cage formed of a plurality of rods within which the twin cutter is mounted, the arrangement being so that said support cage is adapted to be hoisted while said cutters journaled therein tipped with said tip tackle directly connected to said cutter.

8. The dredge of claim 2, wherein said cutter container casing further includes a ground guide mounted on its outer surface for determining the cutting depth.

9. The dredge of claim 1, wherein the hoisting stand is mounted toward the rear of the vessel and wherein said stay tackle means further includes at least one pulley mounted on each side of the vessel forward of the support frame, a winch on the side of the deck of the ship, and said stay tackle means extending obliquely upwards from the support frame to the pulley, said tackle means continuing to the winch.

10. The dredge of claim 9, further comprising compensator means and tension means for insuring accurate cutting depth.

* * * * *